US010388454B1

(12) United States Patent
Herrault et al.

(10) Patent No.: US 10,388,454 B1
(45) Date of Patent: Aug. 20, 2019

(54) LAMINATED CONDUCTORS

(71) Applicant: HRL LABORATORIES, LLC, Malibu, CA (US)

(72) Inventors: Florian G. Herrault, Agoura Hills, CA (US); Melanie S. Yajima, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 16/020,944

(22) Filed: Jun. 27, 2018

Related U.S. Application Data

(62) Division of application No. 14/984,771, filed on Dec. 30, 2015, now Pat. No. 10,062,505.

(51) Int. Cl.

| | |
|---|---|
| ***H01F 41/04*** | (2006.01) |
| ***H01F 41/12*** | (2006.01) |
| ***H01B 13/00*** | (2006.01) |
| *H01B 1/02* | (2006.01) |

(52) U.S. Cl.
CPC ..... *H01F 41/041* (2013.01); *H01B 13/0026* (2013.01); *H01B 13/0036* (2013.01); *H01F 41/122* (2013.01); *H01B 1/02* (2013.01)

(58) Field of Classification Search
None
See application file for complete search history.

(56) References Cited

U.S. PATENT DOCUMENTS

| | | | | |
|---|---|---|---|---|
| 2,831,172 | A | 4/1958 | Morgan | |
| 4,614,563 | A | 9/1986 | Kubo | |
| 5,997,800 | A | 12/1999 | Friedl et al. | |
| 6,002,161 | A | 12/1999 | Yamazaki | |
| 6,148,221 | A | 11/2000 | Ishikawa et al. | |
| 6,980,075 | B2 | 12/2005 | Mheen et al. | |
| 7,140,092 | B2 * | 11/2006 | Park | H01F 17/0013 29/602.1 |
| 8,385,047 | B2 * | 2/2013 | Xie | H01G 4/33 174/257 |
| 8,732,939 | B2 * | 5/2014 | Uchida | H01F 17/0013 29/592.1 |
| 10,062,505 | B1 | 8/2018 | Herrault et al. | |
| 2004/0108311 | A1 | 6/2004 | De Rooij et al. | |
| 2004/0164839 | A1 | 8/2004 | Park et al. | |
| 2009/0160018 | A1 | 6/2009 | Naeshima et al. | |
| 2013/0062729 | A1 | 3/2013 | Hopper et al. | |
| 2013/0199028 | A1 | 8/2013 | Singh et al. | |
| 2014/0084697 | A1 | 3/2014 | Yasuda et al. | |

(Continued)

FOREIGN PATENT DOCUMENTS

| | | | |
|---|---|---|---|
| WO | WO02014/121100 | A1 | 8/2014 |

OTHER PUBLICATIONS

From U.S. Appl. No. 14/984,771 (now U.S. Pat. No. 10,062,505), Restriction/Election dated Feb. 7, 2017.

(Continued)

*Primary Examiner* — Allan W. Olsen
(74) *Attorney, Agent, or Firm* — Ladas & Parry

(57) ABSTRACT

A microfabricated laminated conductor, comprising at least two flat metallic conductors held together parallel by their edges by a first dielectric material anchor, such that there exists a gap of between several nanometers and several micrometers between most of the at least two flat metallic conductors.

11 Claims, 6 Drawing Sheets

(56) References Cited

U.S. PATENT DOCUMENTS

| | | | | |
|---|---|---|---|---|
| 2014/0191838 | A1 | 7/2014 | Yoshida | |
| 2014/0321032 | A1* | 10/2014 | Lazarus | H05K 3/22 361/679.01 |
| 2014/0376199 | A1 | 12/2014 | Kato et al. | |
| 2015/0102889 | A1 | 4/2015 | Choi et al. | |
| 2015/0303214 | A1* | 10/2015 | Kim | H01L 27/11582 257/329 |
| 2016/0005531 | A1 | 1/2016 | Sullivan | |
| 2017/0117222 | A1* | 4/2017 | Kim | H01L 27/11575 |

OTHER PUBLICATIONS

From U.S. Appl. No. 14/984,771 (now U.S. Pat. No. 10,062,505), Non-Final Rejection dated Jun. 13, 2017.

From U.S. Appl. No. 14/984,771 (now U.S. Pat. No. 10,062,505), Final Rejection dated Nov. 15, 2017.

From U.S. Appl. No. 14/984,771 (now U.S. Pat. No. 10,062,505), Notice of Allowance dated May 8, 2018.

"Reduction of Skin-Effect Losses by the Use of Laminated Conductors", by A.M. Clogston, Bell Labs, Proceedings of the IRE (vol. 39, Issue: 7), Jul. 1951, p. 767-782.

"Reduction in Ohmic Loss of Small Microstrip Antennas using Multiple Copper Layers", by Saeed I. Latif et al., Antennas and Propagation Society International Symposium 2006, IEEE, pp. 1625-1628.

* cited by examiner

LAMINATED CONDUCTORS

CROSS REFERENCE TO RELATED APPLICATION

The present disclosure claims the benefit of and is a divisional of U.S. patent application Ser. No. 14/984,771 filed on Dec. 30, 2015, which is hereby incorporated by reference in its entirety.

FIELD OF THE INVENTION

The present invention relates generally to the fabrication of microelectronics components. In particular, the present invention relates to microfabricated low-loss RF conductors and RF spiral inductors and a method of fabricating the same.

BACKGROUND

High frequency conductors can be laminated, and therefore can be electrically anisotropic, featuring low resistance in the direction of the current flow and high resistance in the direction normal to the current flow, which in turns results in low RF losses. At high frequencies, the AC resistance of a conductor is related to the skin depth of the conductor, which is dependent on the permeability of the conductor material, the operating frequency, and the DC resistivity of the conductor material. As the frequency increases, the skin depth becomes smaller, which means that the resistance of a conductor of a given thickness increases with frequency. The loss associated with this phenomenon is due to eddy currents formed within the conductor. In spiral RF inductors, the inductor quality factor is limited by the conductor loss (a high quality factor yields higher circuit efficiency). Reducing RF conductor losses is a key challenge when manufacturing spiral RF inductors. This problem can be addressed by laminating the conductor material.

The document entitled: "Reduction of Skin-Effect Losses by the Use of Laminated Conductors", by A. M. Clogston, Bell Labs, Proceedings of the IRE (Volume: 39, Issue: 7), July 1951, p 767-782, discusses the reduction of skin-effect losses in transmission lines by laminated conductors. The theory is presented for both infinitesimally thin laminated layers and laminated layers of finite thickness.

The document entitled: "Reduction in Ohmic Loss of Small Microstrip Antennas using Multiple Copper Layers", by Saeed I. Latif et al., Antennas and Propagation Society International Symposium 2006, IEEE, pp 1625-1628 demonstrates analytically that multiple laminated conducting material layers reduce the ohmic losses when compared against a single solid layer.

U.S. Pat. No. 2,831,172, entitled: "A Laminated conductor", to Bell Telephone Labor Inc, April 1958, discloses composite conductors formed of a multiplicity of insulated conducting portions which have come to be known as "Clogston conductors".

U.S. Pat. No. 6,148,221, entitled: "A Thin film multilayered electrode of high frequency electromagnetic field coupling", to Murata Manufacturing, November 2000, discloses a plurality of TEM mode transmission lines (L2-L5) structured by pairs of thin film conductors (21 and 22, 22 and 23, 23 and 24, and 24 and 25) which sandwich thin film dielectrics (31 to 34) by alternately stacking the thin film conductor (21 to 25) and the thin film dielectric (31 to 34). The phase velocities of TEM mode waves which are propagated at least by two of the transmission lines (L2 to L5) are substantially equal to each other. The thickness of each of the thin film conductors (21 to 25) is smaller than the skin depth of the frequency used so that the electromagnetic fields of at least two TEM mode transmission lines among the TEM mode transmission lines (L2 to L5) are coupled to each other. In this way, the skin depth can be increased effectively. The conductor loss and the surface resistance can be reduced significantly as compared to those of the conventional electrode. By use of this electrode, a transmission line, a resonator, a filter, and a high frequency device are structured.

Published U.S. Patent application No. 20140376199, entitled: "Laminated multi-conductor cable", to Noboru Kato, 2014, describes a laminate body that includes a plurality of dielectric sheets laminated together. A first ground conductor is provided in or on the laminate body. A second ground conductor is provided in or on the laminate body and located on a different layer from the first ground conductor. A signal line is provided between the ground conductors and with respect to a direction of lamination. A signal line is provided between the ground conductors and with respect to the direction of lamination and located closer to the second ground conductor than the signal line is, and the signal line has a portion extending along the signal line in a parallel-lines area when viewed from the direction of lamination. The first ground conductor has openings in the parallel-lines area, and the openings are arranged over the signal line when viewed from the direction of lamination.

Published U.S. Patent application No. US 20040164839 A1, entitled: "Magnetic inductor core and inductor and methods for manufacturing same", to Georgia Tech Research Corporation, describes a highly-laminated magnetic inductor core and integrated inductor, and methods for making the same. A representative method for manufacturing a highly-laminated magnetic inductor core includes: depositing at least a first layer of a ferromagnetic material; depositing at least a first layer of a sacrificial conductive material; depositing a support structure formed of a ferromagnetic material; and removing the sacrificial conductive material, thereby leaving the at least first layer of ferromagnetic material mechanically supported by the support structure.

Published U.S. Patent application No. US 20130062729 A1, entitled: "Forming a ferromagnetic alloy core for high frequency micro fabricated inductors and transformers", to Texas Instruments, describes a plurality of sequential electro-deposition, planarization and insulator deposition steps performed over a patterned thick photoresist film to form a laminated ferromagnetic alloy core for micro-fabricated inductors and transformers. The use of a plurality of contiguous thin laminations within deep patterns on non-removable photoresist film provides sufficient volume of magnetic film in, for example, high frequency applications, and reduces eddy current loss at high frequency.

U.S. Pat. No. 4,614,563 A, entitled "Process for producing multilayer conductor structure, Fuji Photo Film Co., September 1986" describes a process for producing a multilayer conductor structure having at least two conductor patterns in layers and a smooth surface over the upper pattern, which comprises the steps of: (1) forming a first conductor pattern on a substrate or a layer provided on the substrate; (2) providing a conductor layer over an intermediate insulation layer formed on said first conductor pattern; (3) providing a resin layer on said conductor layer to form a smooth surface thereover; and (4) etching said resin layer and a part of said conductor layer provided on the first conductor pattern to form a second conductor pattern having a smooth surface thereon.

PCT published patent application WO2014121100, entitled "Multilayer conductors with integrated capacitors and associated systems and methods" to THE TRUSTEES OF DARTMOUTH COLLEGE, 2014, discloses a multilayer conductor that includes at least one separation dielectric layer and a plurality of conductor layers stacked in an alternating manner. Each of the plurality of conductor layers includes a first conductor sublayer and a second conductor sublayer separated from the first conductor sublayer by a sublayer dielectric layer. The second conductor sublayer at least partially overlaps with the first conductor sublayer in each of the plurality of conductor layers. The multilayer conductor is included, for example, in a device including a magnetic core adjacent to at least part of the multilayer conductor.

SUMMARY

A purpose of the technology described herein is to manufacture on-wafer conductors with laminated layers of conductive material in order to reduce eddy current losses within the conductors and thereby decrease high-frequency conductor losses. This presentation also relates to a fabrication method that is easy to implement since it only requires one vacuum step for membrane deposition, one photodefinable resist mold, an electrodeposition setup to sequentially deposit multiple layers of a conductive material and a sacrificial conductive material, a selective deposition of an anchor micro-structure to hold the layers in place, followed by removal of the sacrificial material by selective etching, leaving the multiple layers of conductive material to form the laminated conductors.

This presentation relates to a conductor with multiple layers of conductor materials that are electrically isolated in the normal direction to the current flow and low resistance in the current direction, separated mostly by a fluid or a void and anchored by a polymeric or dielectric material.

This presentation also relates to a method comprising sequentially electroplating multiple layers of a conductor material and a sacrificial metallic material in an upwardly turned recess in a temporary mold structure (e.g. made of photoresist). A polymeric anchor is then deposited in place of some selectively etched sacrificial material portions, followed by completing the etching of the sacrificial material. Such fabrication method is compatible with wafer-level processing and standard microfabrication technologies.

An embodiment of this presentation comprises a microfabricated laminated conductor, comprising: at least two flat metallic conductors held together parallel by their edges by a first dielectric material anchor, such that a gap of between several nanometers and several micrometers is formed between most of the at least two flat metallic conductors.

According to an embodiment of this presentation, each of the at least two flat metallic conductors have first and second extremities and the first extremities of the at least two flat metallic conductors are electrically connected together. The second extremities of the at least two flat metallic conductors can also be electrically connected together.

According to an embodiment of this presentation, the first extremities of the at least two flat metallic conductors are electrically connected to a common conductor.

According to an embodiment of this presentation, each of the least two flat metallic conductors has a thickness of between several nanometers and several micrometers.

According to an embodiment of this presentation, a portion of said first dielectric material anchor is arranged between the at least two flat metallic conductors.

According to an embodiment of this presentation, the at least two flat metallic conductors comprise Au, Ag or Cu.

According to an embodiment of this presentation, the surfaces of said at least two flat metallic conductors separated by said gap are covered by a dielectric material coating.

According to an embodiment of this presentation, said dielectric material coating comprises at least BCB or Al2O3 or chemical vapor deposited poly(p-xylylene) polymers.

According to an embodiment of this presentation, said first dielectric material anchor holds one edge of each of said at least two flat metallic conductors.

According to an embodiment of this presentation, the microfabricated laminated conductor comprises a second dielectric material anchor that holds another edge of each of said at least two flat metallic conductors.

An embodiment of this presentation comprises planar inductor comprising: a substrate; a microfabricated laminated conductor of the embodiments outlined above, attached to the substrate and forming at least one turn of a spiral having an inner end and an outer end; the inner end of the spiral being coupled to a conductive line attached to the substrate; the microfabricated laminated conductor comprising at least an inner portion running from the inner end of the spiral to a vicinity of said conductive line; and the microfabricated laminated conductor comprising at least an outer portion running from the outer end of the spiral to a vicinity of said conductive line; a coupling portion comprising a first conductive bridge locater over, and isolated from, said conductive line, the coupling portion coupling the inner portion of the conductor to the outer portion of the conductor.

According to an embodiment of this presentation, said coupling portion further comprises an additional portion of the laminated conductor, forming one loop of said spiral and a second conductive bridge located over, and isolated from, said conductive line; said first conductive bridge coupling the outer portion of the laminated conductor to the additional portion of the laminated conductor; and said second conductive bridge coupling the additional portion of the laminated conductor to the inner portion of the laminated conductor.

An embodiment of this presentation comprises a RF circuit, comprising: a planar inductor according to one of the embodiments above; a first waveguide coupled to said outer end of the spiral; and a second waveguide coupled to said conductive line.

An embodiment of this presentation comprises a method for making a microfabricated laminated conductor, the method comprising: providing a carrier substrate; forming a metal seed layer on the substrate; forming on the metal seed layer a sacrificial mold having a recess exposing the metal seed layer; forming a first flat metallic conductor in said recess on said metal seed layer; forming a sacrificial layer on said first flat metallic conductor; forming a second flat metallic conductor on said sacrificial layer; removing said sacrificial mold; etching a peripheral portion of said sacrificial layer, thus forming a gap between the edges of said first and second flat metallic conductors; forming a dielectric material anchor on at least one side of said first and second flat metallic conductors such that a portion of the dielectric material anchor is arranged between said first and second flat metallic conductors; removing the metal seed layer remaining exposed; and removing the remainder of said sacrificial layer.

According to an embodiment of this presentation, each of the at least two flat metallic conductors have first and second extremities; and the method comprises electrically connecting together the first extremities of the at least two flat metallic conductors. The method can also comprise electrically connecting together the second extremities of the at least two flat metallic conductors.

According to an embodiment of this presentation, the method comprises electrically connecting the first extremities of the at least two flat metallic conductors to a common conductor.

According to an embodiment of this presentation, said sacrificial layer has a thickness of between several nanometers and several micrometers.

According to an embodiment of this presentation, said flat metallic conductors have each a thickness of between several nanometers and several micrometers.

According to an embodiment of this presentation, said flat metallic conductors comprise Au, AG or Cu.

According to an embodiment of this presentation, said sacrificial layer comprises Ni.

According to an embodiment of this presentation, forming said flat metallic conductors and said sacrificial layer is done by electroplating.

According to an embodiment of this presentation, the method further comprises depositing a dielectric coating on said two flat metallic conductors after removing the remainder of said sacrificial layer.

An embodiment of this presentation comprises a method of forming a planar inductor, the method comprising: forming a conductive pad layer on a substrate; forming on the conductive pad layer a sacrificial mold exposing the conductive pad layer along at least two recesses in the shape of one turn of a spiral interrupted by a radial cut: a first recess developing from an inner end of the spiral to said radial cut; and a second recess developing from the radial cut to an outer end of the spiral; in each recess of the sacrificial mold, forming a conductive stack comprising at least a first flat conductor covering the exposed portion of the conductive layer; a sacrificial layer covering said first flat conductor; and a second flat conductor covering said sacrificial layer; removing the sacrificial mold; etching away the conductive pad layer not covered by the conductive stacks, except: along a first waveguide connecting to the outer end of the spiral; along a second waveguide connecting to the inner end of the spiral through the radial cut in the spiral; and along ground pads arranged at a distance of the conductive stacks and the first and second waveguides; forming a photoresist layer covering at least the second waveguide in the radial cut in the spiral without covering the top portions of the conductive stacks, and forming on the photoresist layer a conductive bridge connecting the top portion of the conductive stacks above the radial cut in the spiral; removing the photoresist layer; etching a peripheral portion of the sacrificial layer of the conductive stacks, thus forming a gap between the edges of the first and second flat conductors of the conductive stacks; forming a dielectric material anchor on at least one side of said first and second flat conductors of the conductive stacks such that a portion of the dielectric material anchor is arranged in said gap between said first and second flat conductors; and removing the remainder of said sacrificial layer of the conductive stacks.

According to an embodiment of this presentation, in the method above, said forming said sacrificial mold exposing the conductive pad layer along at least two recesses in the shape of one turn of a spiral interrupted by a radial cut comprises forming: a first recess developing from an inner end of the spiral to a first side of said radial cut, at a first distance from the center of the spiral; a second recess developing from a second side of the radial cut, at a second distance from the center of the spiral, to an outer end of the spiral; and at least a third recess developing along one loop of the spiral between the second side of said radial cut, at said first distance from the center of the spiral and the first side of said radial cut, at said second distance from the center of the spiral; and forming said conductive bridge above said radial cut comprises forming a first conductive bridge above the radial cut at said first distance from the center of the spiral and forming a second conductive bridge above the radial cut at said second distance from the center of the spiral.

BRIEF DESCRIPTION OF THE DRAWINGS

The invention(s) may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
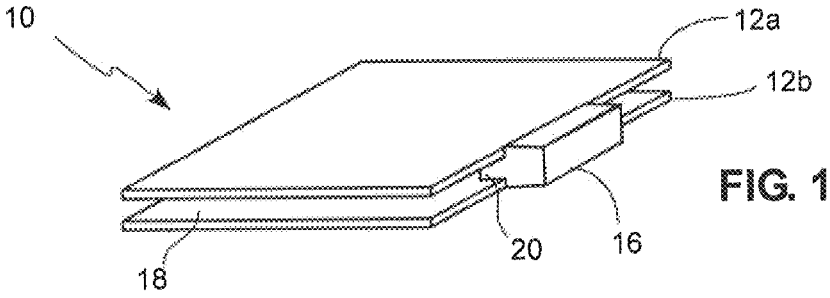
FIG. 1 illustrates an elevation view of a microfabricated laminated conductor according to an embodiment of this presentation.

FIG. 1 illustrates an elevation view of a microfabricated laminated conductor 10 according to an embodiment of this presentation; the microfabricated laminated conductor 10 comprising two or more flat metallic conductors 12*a*, 12*b*, held together parallel by their edges by a first dielectric material anchor 16, such that a gap 18 comprised between several nanometers and several micrometers is formed between at least most of the surface of the two or more flat metallic conductors 12*a*, 12*b*. According to an embodiment of this presentation, a portion 20 of said first dielectric material anchor is arranged between the remainder of the surface of the at least two flat metallic conductors, and helps holding the flat conductors 12*a*, 12*b* together. As detailed hereafter, the size of portion 20 can be varied when manufacturing the microfabricated laminated conductor 10. According to an embodiment of this presentation, no portion 20 is present and the dielectric material anchor holds the flat conductors 12*a*, 12*b* together only by their sides.

According to an embodiment of this presentation, each of the two or more flat metallic conductors 12*a*, 12*b* has a thickness of between several nanometers and several micrometers, and can comprise Au, Ag or Cu (alone or in combination), as well as any metal as long as it satisfies the conditions of electroplating, and that the sacrificial layer can be selectively etched away for said metal. It is noted that even though the flat conductors 12*a*, 12*b* are shown as planar in FIG. 1, the flat conductors 12*a*, 12*b* can also be non-planar and for example follow a curve or comprise bumps or cuts, as long as the two metallic conductors 12*a*, 12*b* have surfaces that develop substantially parallel to each other. According to an embodiment of this presentation, the microfabricated laminated conductor 10 can be arranged such that gap 18 is filled with a fluid such as air or a gas, or is maintained in a void.

According to an embodiment of this presentation, the first dielectric material anchor 16 holds at least a portion of one edge of each of said at least two flat conductors 12*a*, 12*b*. As detailed hereafter, at least a second dielectric material anchor can hold another portion of the same edge of conductors 12*a*, 12*b* or at least a portion of another edge of flat conductors 12*a*, 12*b*. According to an embodiment of this presentation the surfaces of said at least two flat metallic conductors 12*a*, 12*b* separated by said gap 18 can be covered by a dielectric material coating, which may comprise parylene, BCB or Al2O3 such as ALD-deposited Al2O3, or chemical vapor deposited poly(p-xylylene) polymers.

Figure 2:
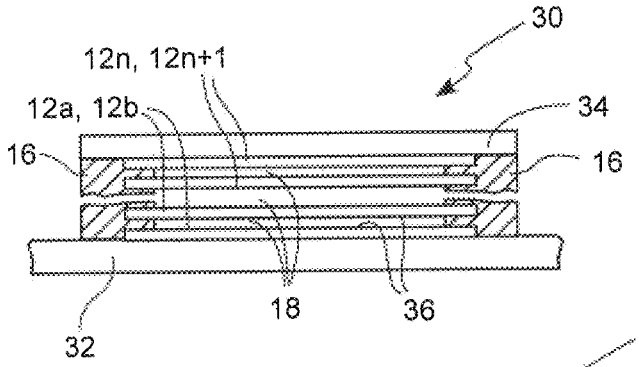
FIG. 2 illustrates a front view of a microfabricated laminated conductor according to an embodiment of this presentation.

FIG. 2 illustrates a front view of a microfabricated laminated conductor 30 according to an embodiment of this presentation comprising a plurality of flat conductors 12*a*, 12*b*, . . . 12*n*, 12*n*+1 held together parallel by at least a portion of their edges by two dielectric material anchors 16, such that a gap 18 of between several nanometers and several micrometers is formed between most of the flat conductors 12*a*, 12*b*, . . . 12*n*, 12*n*+1. According to an embodiment of this presentation, a first flat conductor 12*a* is attached to a substrate 32 and the two dielectric material anchors 16 are attached together by a joining part 34, which may be in the same dielectric material as anchors 16. As outlined above, the surfaces of the flat conductors 12*a*, 12*b*, . . . 12*n*, 12*n*+1 separated by gap 18 can be covered by a dielectric material coating 36. According to an embodiment of this presentation, n can be of the order of the hundred or the thousand or more; or less.

Figure 3:
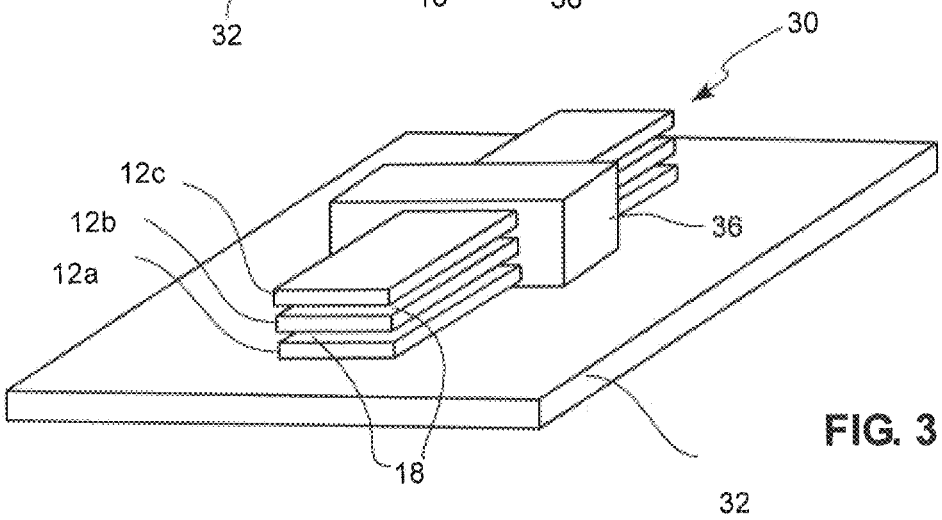
FIG. 3 illustrates an elevation view of a microfabricated laminated conductor according to an embodiment of this presentation.

FIG. 3 illustrates an elevation view of an exemplary microfabricated laminated conductor 30 such as illustrated in FIG. 2, having three flat conductors 12*a*, 12*b*, 12*c*, wherein the two dielectric material anchors 16 and joining part 34 form a single anchor 37 holding portions of the edges on two opposite sides of flat conductors 12*a*, 12*b*, 12*c*.

Figure 4A:
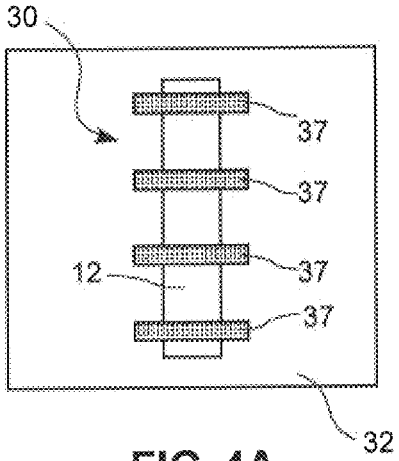
FIG. 4A illustrates a top view of a microfabricated laminated conductor according to an embodiment of this presentation.

FIG. 4A illustrates a top view of an exemplary microfabricated laminated conductor 30 such as illustrated in FIG. 3, comprising four anchors 37 along the length of the flat conductors 12.

Figure 4B:
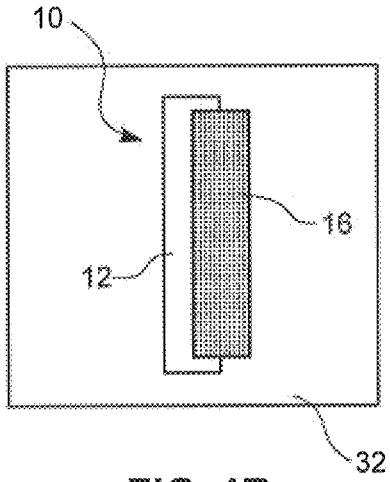
FIG. 4B illustrates a top view of a microfabricated laminated conductor according to an embodiment of this presentation.

FIG. 4B illustrates a top view of an exemplary microfabricated laminated conductor 10 such as illustrated in FIG. 1, comprising a single anchor 16 along a portion of the length of one side of the flat conductors 12. As illustrated, in the figures, microfabricated laminated conductor 10 can be attached to a substrate 32, for example by a lower flat conductor 12 or by a lower side of anchor 16, and anchor 16 can have a portion that overlaps the top surface of a top flat conductor 12.

Figure 4C:
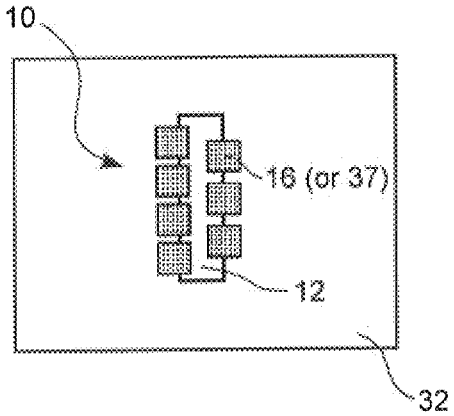
FIG. 4C illustrates a top view of a microfabricated laminated conductor according to an embodiment of this presentation.

FIG. 4C illustrates a top view of an exemplary microfabricated laminated conductor 10 as illustrated in FIG. 1, but comprising a plurality of anchors 16 along consecutive portions of the length of a first side of the flat conductors 12, and comprising a plurality of anchors 16 along consecutive portions of the length of a second side of the flat conductors 12, the anchors 16 on the first and second sides being staggered for example as illustrated.

According to an embodiment of this presentation, each anchor 16 can have a portion that overlaps the top surface of a top flat conductor 12.

Figure 5A:
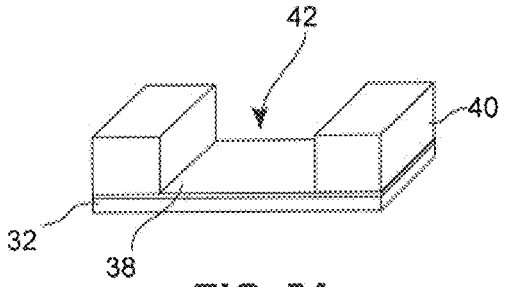
FIGS. 5A to 5G are elevation views illustrating the manufacture of a microfabricated laminated conductor according to an embodiment of this presentation.

FIGS. 5A to 5G are mostly elevation views illustrating a method according to an embodiment of this presentation, of manufacture of a microfabricated laminated conductor such as illustrated in FIGS. 2, 3. As illustrated in FIG. 5A, the method comprises providing a carrier substrate 32; forming a metal seed layer 38 on the substrate 32; and forming on the metal seed layer 38 a sacrificial mold 40 having a recess 42 exposing along a desired shape the metal seed layer 38. The desired shape can be a rectangle or a portion of a spiral, as described hereafter, or any suitable shape. The substrate 32 can for example be made of silicon, SIC, sapphire, alumina or PCB. The metallic membrane/metal seed layer 38 can be deposited through conventional sputtering technology. The sacrificial mold 40 can be formed in a thick photoresist layer that is spin coated onto the metalized substrate using conventional photo-lithography techniques. FIG. 5A shows only two walls of mold 40 but mold 40 can comprise as many walls as required to enclose a surface of metal layer 38 on which the microfabricated laminated conductor is to be built.

Figure 5B:
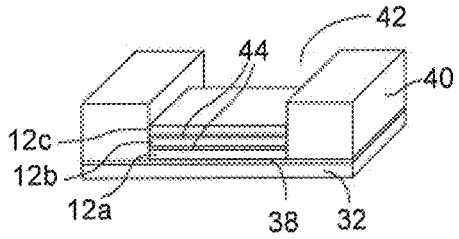

As illustrated in FIG. 5B, according to an embodiment of this presentation the method further comprises forming a first flat metallic conductor 12*a* in said recess 42 on said metal seed layer 38; forming a sacrificial layer 44 on said first flat metallic conductor 12*a*; and forming a second flat metallic conductor 12*b* on sacrificial layer 44. According to an embodiment of this presentation, the thickness of flat metallic conductor 12*a* is dependent on the desired operating frequency and should not exceed 3 times the skin depth of the material at that frequency, but it can be thinner than the skin depth value. For reference, the skin depth of electroplated gold at 10 GHz is on the order of 0.7 microns. According to an embodiment of this presentation, the thickness of the conductors can be of about one micron.

According to an embodiment of this presentation, flat conductor 12*a* can be made by electrodeposition. According to an embodiment of this presentation, the sacrificial material can be nickel. The layer 44 of sacrificial material can be deposited through electroplating. Nickel can be selected for laminated gold conductors 12, but generally the sacrificial conductive material should feature: 1) electroplating compatibility with the selected conductive material, 2) be very conductive; this is a requirement to sequentially electroplate a large numbers of laminations, 3) ability to be selectively etched away from the conductive material without degrading it; 4) feature low stress and low plating roughness. For laminated gold conductors, nickel satisfies all the requirements to be used as a sacrificial conductive material. According to an embodiment of this presentation, the thickness of the sacrificial material layer 44 is preferentially smaller than the thickness of the conductor material layer 12.

FIG. 5B illustrates forming a further sacrificial layer 44 on top of conductor 12*b*, and forming conductor 12*c* on top of the further sacrificial layer 44. A microfabricated laminated conductor according to an embodiment of this presentation comprises at least two flat conductors 12 (12*a*, 12*b*) but it can comprise more than two flat conductors; the only constraint being the total thickness of the mold 40, which must not be exceeded during the fabrication of the conductors 12.

Preferably, the material of metallic membrane 38 provides good adhesion to the substrate 32, good adhesion to the photoresist used as a plating mold 40 for the laminated conductors, and compatibility with the metals of conductors 12 (12*a*, 12*b*, etc. . . . ). For example, in the case of laminated gold conductors 12 on a semiconductor wafer, one would preferentially select a titanium/gold membrane 38, with thicknesses of 200 A and 1000 A, respectively. In the case of laminated copper conductors 12, one would preferentially select a titanium/copper/titanium membrane 38 with thickness of 200 A, 1000 A and 200 A, respectively. For the purpose of this presentation, we will consider the fabrication of laminated gold conductors 12, but experts in the field will acknowledge the potential for fabrication of laminated conductors 12 with a variety of metals.

Figure 5C:
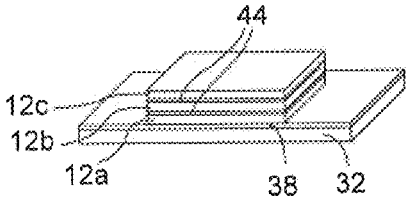

FIG. 5C illustrates an intermediary structure according to an embodiment of this presentation, after removing the sacrificial mold 40. Mold 40 can be removed through conventional fabrication processes such as photoresist development or solvent-based removal.

Figure 5D:
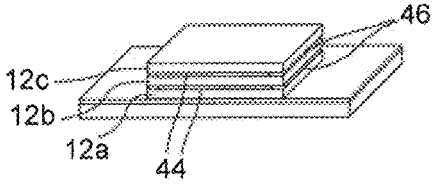

As illustrated in FIG. 5D, the method according to an embodiment of this presentation further comprises etching a peripheral portion of sacrificial layer, 44 thus forming a peripheral gap 46 between the edges of the flat metallic conductors 12 (12*a*, 12*b*, . . . ). According to an embodiment of this presentation, peripheral gap 46 (or lateral recess 46) can have a lateral depth of the order of one or more microns.

Figure 5E:
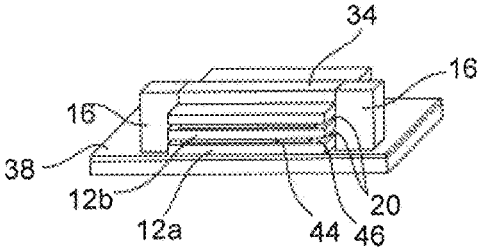

As illustrated in FIG. 5E, the method according to an embodiment of this presentation further comprises forming a dielectric material anchor 16 on at least one side of the flat metallic conductors 12 such that a portion 20 of the dielectric material anchor 16 is arranged between a portion of the peripheral edge of the flat metallic conductors 12 (12*a*, 12*b*, . . . ). In FIG. 5E, two dielectric anchors 16 are illustrated; joined by a joining part 34. The dielectric material of the anchor can be polymeric. According to an embodiment of this presentation, the anchor does not electrically short the laminated conductor layer 12. The anchor can for example be made out of a photoresist or photodefinable dielectric. It can be deposited above all the conductors 12 and then patterned to form the desired anchor shape. As detailed above in relation with FIGS. 4A and 4B, the anchor structure can have the form of a plurality of spokes 37 distributed across the length of the conductors 12 at regular interval, or of a single-sided anchor 16 running parallel along the conductors 12. According to the embodiments where the dielectric material anchor holds the flat conductors 12 together only by their sides, the etching a peripheral portion can be skipped, and no portion 20 exists.

Figure 5F:
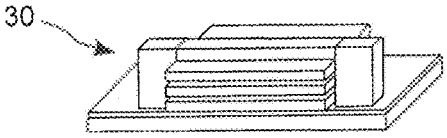
Figure 5G:
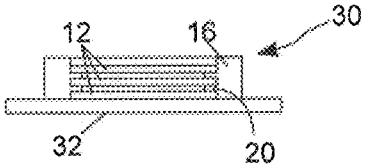

As illustrated in FIG. 5F, the method according to an embodiment of this presentation further comprises removing the metal seed layer 38 remaining exposed; and removing the remainder of said sacrificial layer 44 between the conductors 12. According to an embodiment of this presentation, the sacrificial layers 44 can be completely removed by means of chemical or electrochemical etching, for example in conjunction with the removal of the membrane 38 remaining exposed. According to an embodiment of this presentation, the metal seed layer 38 can be removed prior to forming the anchor 16, for example when forming the recesses 46. According to an embodiment of this presentation, the microfabricated conductor 30 is anisotropic, theoretically featuring infinite resistance in the direction normal (out-of-plane) to the laminations 12, and low resistance in the in-plane direction. FIG. 5G is a front view of the finished microfabricated conductor 30 shown in FIG. 5F. According to an embodiment of this presentation, the purpose of anchor 16 is to maintain the conductor layers 12 parallel, and to maintain a physical gap (that can be filled with air or fluid, or void) between the laminations/conductor layers 12. According to an embodiment of this presentation, sacrificial layer 44 has a thickness of between several nanometers and several micrometers and the metallic conductors 12 have each a thickness of between several nanometers and several micrometers.

According to an embodiment of this presentation, the flat metallic conductors 12 comprise Au, AG or Cu and the sacrificial layer comprises Ni.

According to an embodiment of this presentation, the method further comprises depositing a dielectric coating 36 as shown in FIG. 2 on the exposed portions of the flat metallic conductors 12, after removing the remainder of the sacrificial layer 44.

Test structures were microfabricated; which consisted of four layers of electroplated gold as the conductive material layers (~1.5 μm thickness per layer) and three layers of nickel (~0.75 μm thickness per layer) as the sacrificial conductive material layers. The anchor structure consisted of cured photoresist. The nickel was chemically etched away using the Transene Nickel etchant TFG solution at 25 C for 30 minutes. The test structure demonstrated that the selective etching of the sacrificial layer did not degrade the conductive material layers (i.e., gold layers).

Figure 6:
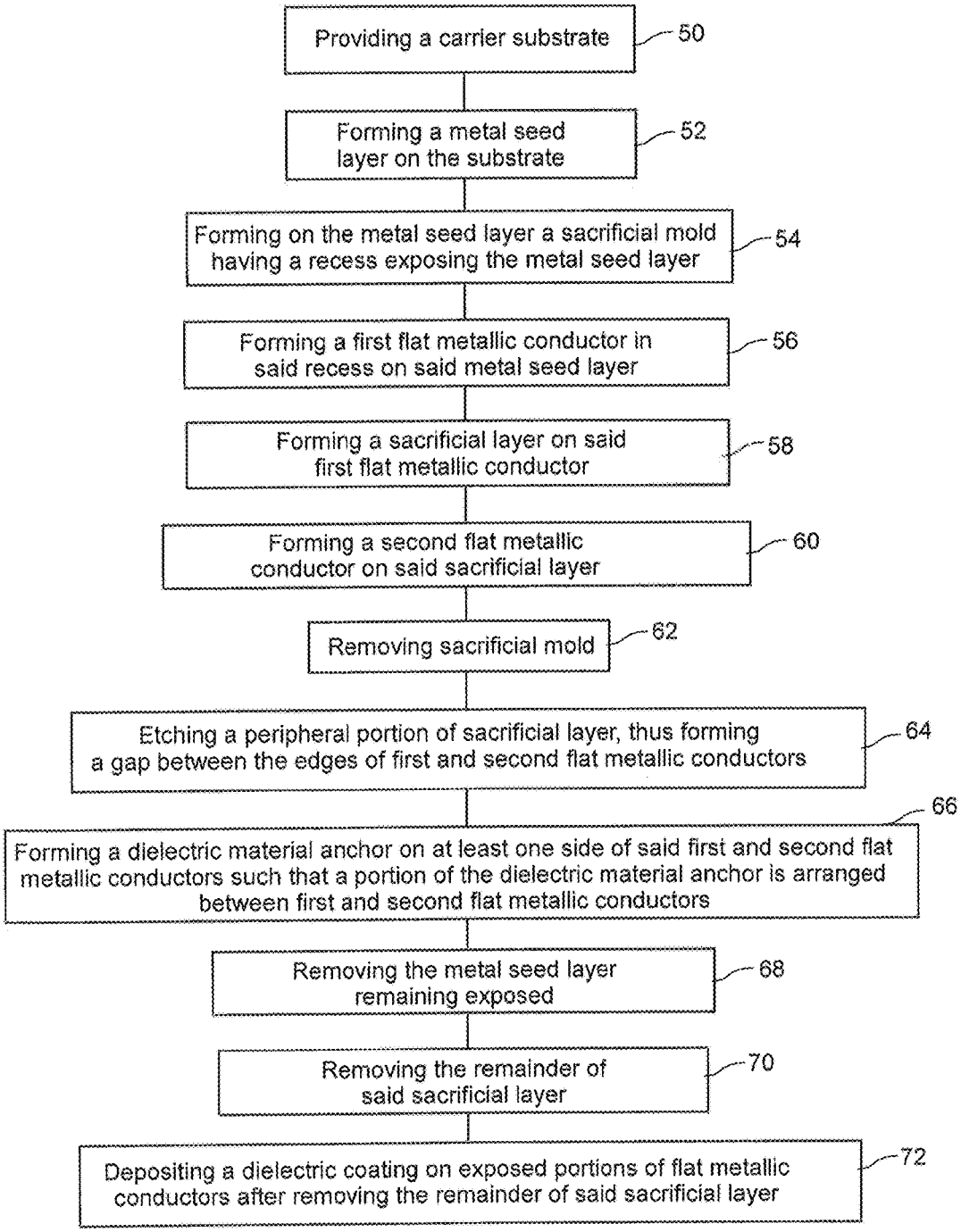
FIG. 6 is an organigram defining a method for making a microfabricated laminated conductor according to an embodiment of this presentation.

FIG. 6 is an organigram describing a method for making a microfabricated laminated conductor according to an embodiment of this presentation, the method comprising: providing (50) a carrier substrate; forming (52) a metal seed layer on the substrate; forming (54) on the metal seed layer a sacrificial mold having a recess exposing the metal seed layer along a desired shape; forming (56) a first flat metallic conductor covering said exposed metal seed layer in said recess; forming (58) a sacrificial layer covering said first flat metallic conductor; forming (60) a second flat metallic conductor covering said sacrificial layer; removing (62) said sacrificial mold; etching (64) a peripheral portion of said sacrificial layer, thus forming a gap between the edges of said first and second flat metallic conductors; (64) forming a dielectric material anchor on at least one side of said first and second flat metallic conductors such that a portion of the dielectric material anchor is arranged between said first and second flat metallic conductors; removing (68) the metal seed layer remaining exposed; and removing (70) the remainder of said sacrificial layer.

Optionally, the method further comprises depositing (72) a dielectric coating on the two flat metallic conductors after removing the remainder of said sacrificial layer.

Figure 7:
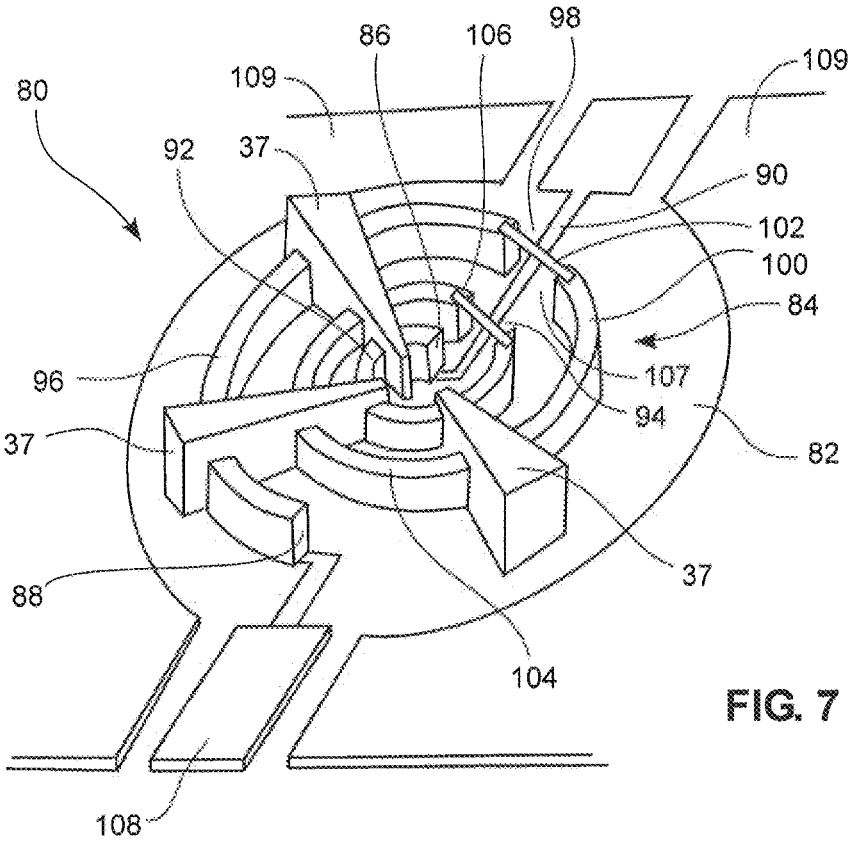
FIG. 7 illustrates an elevation view of a planar inductor that uses a microfabricated laminated conductor according to an embodiment of this presentation.

FIG. 7 illustrates an elevation view of a planar inductor 80 that uses a microfabricated laminated conductor according to an embodiment of this presentation.

According to an embodiment of this presentation, planar inductor 80 comprises: a substrate 82; a microfabricated laminated conductor 84 such as described above, for example in relation with FIGS. 1 to 5. According to an embodiment of this presentation, microfabricated laminated conductor 84 is attached to the substrate by its lower conductor and forms at least one turn of a spiral, having an inner end 86 and an outer end 88; the inner end 86 of the spiral being coupled to a conductive line/waveguide 90 attached to the substrate.

According to an embodiment of this presentation, the microfabricated laminated conductor 84 comprises at least an inner portion 92 running from the inner end 86 of the spiral to a vicinity 94 of said conductive line 90; and the microfabricated laminated conductor 84 comprises at least an outer portion 96 running from the outer end 88 of the spiral to a vicinity 98 of said conductive line 90. According to an embodiment of this presentation, outer end 88 of the spiral can be connected to a conductive conductor, such as a metallic plate or strip, electrically connected to the extremities of the conductors of microfabricated laminated conductor 84. Electrical connection can be achieved using solder or a conductive glue.

According to an embodiment of this presentation, the planar inductor 80 further comprises a coupling portion 100 comprising a first conductive bridge 102 that is located over, and isolated from, said conductive line 90, the coupling portion 100 coupling the inner portion 92 of the laminated conductor 84 to the outer portion 96 of the laminated conductor 84.

According to an embodiment of this presentation, the coupling portion 100 further comprises: an additional portion 104 of the laminated conductor 84, forming one loop of said spiral; and a second conductive bridge 106 located over, and isolated from, said conductive line 90; the first conductive bridge 102 coupling the outer portion 96 of the laminated conductor 84 to the additional portion 104 of the laminated conductor; and the second conductive bridge 106 coupling the additional portion 104 of the laminated conductor 84 to the inner portion 92 of the laminated conductor 84. It is to be understood that the coupling portion 100 is illustrated with one additional portion of the laminated conductor forming one loop of the spiral and one second conductive bridge, but that the coupling portion 100 can according to an embodiment of this presentation comprise a plurality of additional portions of the laminated conductor 84 forming each one loop of the spiral, and a corresponding plurality of second conductive bridges.

According to an embodiment of this presentation, each portion 92, 96, 104 of the laminated conductor 84 comprises a plurality of flat conductors 12 (as shown on FIGS. 1-5) held parallel with a gap 18 between most of the surface of the conductors 12. According to an embodiment of this presentation, the conductors 12 are held parallel by at least a part of their edges by dielectric anchors 37. In the embodiment illustrated in FIG. 7, each anchor 37 develops radially from the center of the spiral, and holds the conductors 12 of more than one portion 92, 96, 104 of the laminated conductor 84. According to an embodiment of this presentation, portions 20 of the dielectric anchor 37 are arranged between parts of the surfaces of the conductors 12, for example as described in relation with FIGS. 1-5. According to an alternative embodiment of this presentation, each portion 92, 96, 104 of the laminated conductor 84 can comprise a distinct set of anchors 37.

FIG. 7 also shows a RF circuit according to an embodiment of this presentation; the RF circuit comprising: the planar inductor 80; a waveguide 108 coupled to the outer end 88 of the spiral; and ground pads 109 arranged at a distance from the planar inductor and the waveguides.

Figure 8A:
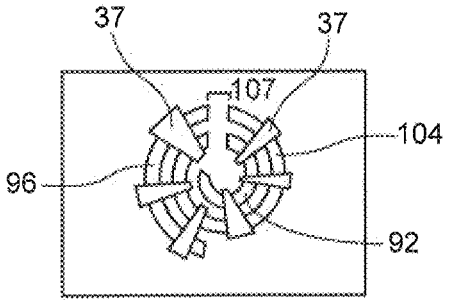
FIG. 8A illustrates a top view of a planar inductor structure that uses a microfabricated laminated conductor according to an embodiment of this presentation.

FIG. 8A is a copy of a scanning electron micrograph showing a top view of the structure of planar inductor 80. According to an embodiment of this presentation, the anchors 37 can be shaped and arranged such that they are distributed at regular intervals along the laminated conductor 84. FIG. 8A shows that the spiral laminated conductor 84 comprises a radial cut 107 to let the conductive line 90 (not shown) pass from the outside of the spiral to the inner end of the spiral.

Figure 8B:
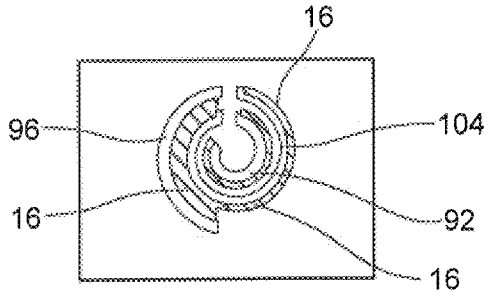
FIG. 8B illustrates a top view of a planar inductor structure that uses a microfabricated laminated conductor according to an embodiment of this presentation.

FIG. 8B is a scanning electron micrograph showing a top view of the structure of an alternative embodiment of planar inductor 80, wherein instead of being held by radially arranged anchors 37, the conductors 12 of the laminated conductor 84 are held each by a portion of one edge only by a lateral anchor 16 as shown for example in FIGS. 1 and 4B. As illustrated in FIG. 8B, the lateral anchor 16 that holds one portion (e.g. outer portion 96) of the laminated conductor 84 can be integral with a portion of the lateral anchor 16 that holds another portion (e.g. additional portion 104) of the laminated conductor 84.

Figure 9:
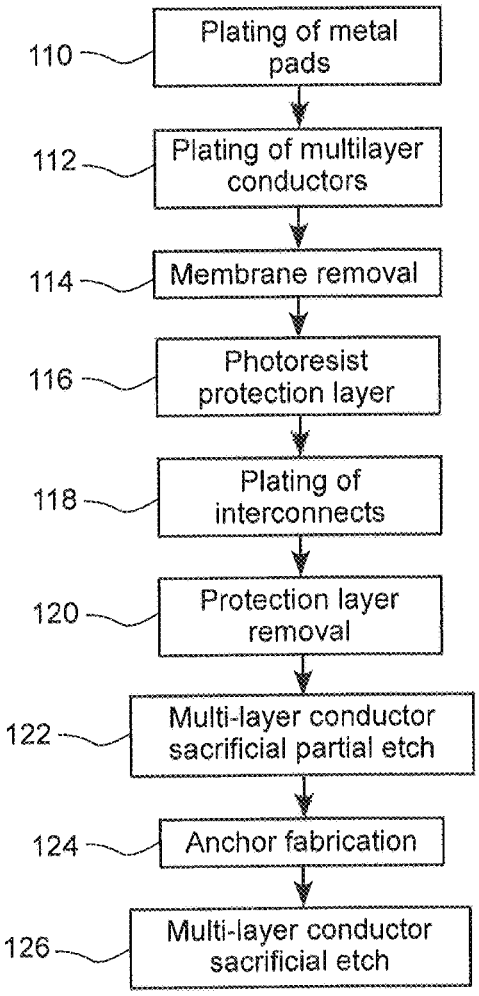
FIG. 9 is an organigram of a method of forming a planar inductor according to an embodiment of this presentation.

FIG. 9 is an organigram of a method of forming a planar inductor according to an embodiment of this presentation. According to an embodiment of this presentation, the method comprises: forming (110) a conductive pad layer on a substrate; forming (112) on the conductive pad layer a sacrificial mold exposing the conductive pad layer along at least two recesses in the shape of one turn of a spiral interrupted by a radial cut: a first recess developing from an inner end of the spiral to said radial cut; and a second recess developing from the radial cut to an outer end of the spiral; and, in each recess of the sacrificial mold, forming a conductive stack comprising at least a first flat conductor covering the exposed portion of the conductive layer; a sacrificial layer covering said first flat conductor; and a second flat conductor covering said sacrificial layer; and removing the sacrificial mold; then etching away (114) the conductive pad layer not covered by the conductive stacks, except: along a first waveguide connecting to the outer end of the spiral; along a second waveguide connecting to the inner end of the spiral through the radial cut in the spiral; and along ground pads arranged at a distance of the conductive stacks and the first and second waveguides.

According to an embodiment of this presentation, the method further comprises forming (116) a photoresist layer covering at least the second waveguide in the radial cut in the spiral without covering the top portions of the conductive stacks, and forming (118) on the photoresist layer a conductive bridge connecting the top portion of the conductive stacks above the radial cut in the spiral; removing (120) the photoresist layer; etching (122) a peripheral portion of the sacrificial layer of the conductive stacks, thus forming a gap between the edges of the first and second flat conductors of the conductive stacks; forming (124) a dielectric material anchor on at least one side of said first and second flat conductors of the conductive stacks such that a portion of the dielectric material anchor is arranged in said gap between said first and second flat conductors; and removing (126) the remainder of said sacrificial layer of the conductive stacks.

According to an embodiment of this presentation, the bridge can be formed by electroplating on a sputtered layer.

According to an embodiment of this presentation, the bridge can have a thickness of one micron.

According to an embodiment of this presentation, in the method above, said forming (112) said sacrificial mold exposing the conductive pad layer along at least two recesses in the shape of one turn of a spiral interrupted by a radial cut comprises forming: a first recess developing from an inner end of the spiral to a first side of said radial cut, at a first distance from the center of the spiral; a second recess developing from a second side of the radial cut, at a second distance from the center of the spiral, to an outer end of the spiral; and at least a third recess developing along one loop of the spiral between the second side of said radial cut, at said first distance from the center of the spiral and the first side of said radial cut, at said second distance from the center of the spiral; and said forming (118) said conductive bridge above said radial cut comprises forming a first conductive bridge above the radial cut at said first distance from the center of the spiral and forming a second conductive bridge above the radial cut at said second distance from the center of the spiral.

It is intended that the scope of the invention be defined by the claims appended hereto and their equivalents. Reference to an element in the singular is not intended to mean "one and only one" unless explicitly so stated, but rather means "one or more." Moreover, no element, component, nor method step in this presentation is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . "

It should be understood that the figures illustrated in the attachments, which highlight the functionality and advantages of the present invention, are presented for example purposes only.

Furthermore, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of this presentation. The Abstract is not intended to be limiting as to the scope of the present invention in any way. It is also to be understood that the steps and processes recited in the claims need not be performed in the order presented.

Also, it is noted that the embodiments may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

The various features of the invention described herein can be implemented in different systems without departing from the invention. It should be noted that the foregoing embodiments are merely examples and are not to be construed as limiting the invention. The description of the embodiments is intended to be illustrative, and not to limit the scope of the claims. As such, the present teachings can be readily applied to other types of apparatuses and many alternatives, modifications, and variations will be apparent to those skilled in the art.

For example, embodiments comprising a planar inductor have been detailed but this presentation can also be used to make an antenna or a transmission line or an interconnect, for example.

Also, embodiments of this presentation relate to a method for microfabricating laminated metallic conductors, the method comprising: deposition of a seed layer on a substrate; coating of photodefinable resist and patterning; deposition of at least a first layer of a conductive material; deposition of at least a first layer of a sacrificial conductive material, which must be low resistivity and compatible with selective etching of the conductive material; deposition of at least a second layer of a conductive material; partial and selective removal of the sacrificial conductive material; removal of the photodefinable resist and seed layer; fabrication of an anchor structure formed by a polymeric material; complete removal of the sacrificial conductive material, thereby leaving the at least first layer of conductive material and a second layer of conductive material mechanically supported by the anchor structure; optional coating of interlamination air gaps with a dielectric.

According to embodiments of this presentation, the metallic interconnects can comprise Au, or Ag, or Cu, as well as any metal as long as it satisfies the conditions of electroplating, and that the sacrificial layer can be selectively etched away for said metal.

A method according to an embodiment of this presentation comprises: deposition of a membrane on top of a substrate, the membrane being Ti/Au (200 A/3000 A) or Ti/Cu (200 A/3000 A) or Ti/Ag (200 A/3000 A); deposition and patterning of a photodefinable resin mold for pad and underpass fabrication; electrodeposition of a conductive material (Cu, Ag, or Au) to form coplanar waveguide launchers and inductor underpass for inductor to pad interconnections, the plated metal being no less than 1 micron; deposition and patterning a photodefinable resist mold on top of the launchers and inductor underpass to form the laminated conductors; deposition/electrodeposition of at least a first layer of a conductive material, at least a first layer of a sacrificial conductive material, and at least a second layer of a conductive material through the photodefinable resist mold; removal of the photoresist mold; removal of the membrane; partial removal of the sacrificial conductive material; deposition of a membrane; deposition and patterning of a photodefinable resin mold to form interconnects; electrodeposition of a conductive material (Cu, Ag, or Au) to form interconnects, the plated metal being no less than 1 micron; removal of the photoresist mold; removal of the membrane; fabrication of an anchor structure formed by a polymeric material; complete removal of the sacrificial conductive material, thereby leaving the at least a first layer of conductive material and a second layer of conductive material mechanically supported by the anchor structure; optional coating of interlamination air gaps with a dielectric.

An embodiment of this presentation comprises a laminated metallic conductor having: at least two layers of metallic conductor separated by a dielectric and anchored by non-removable photodefinable resin formed on a substrate.

An embodiment of this presentation comprises a planar inductor with laminated conductors comprising: metallic coplanar waveguide pads and an underpass to connect the inductor trace to inductor pads, and at least two layers of metallic conductors separated by a dielectric and anchored on a substrate, and metallic interconnects to connect the pads to the laminated conductors.

The embodiments described above preferably comprise flat metallic conductors, but other embodiments of this presentations can comprise other electricity conducting materials, such as semiconductors or light conducting materials, as long as the sacrificial layer can be selectively etched away for said materials.

The invention claimed is:

1. A method for making a microfabricated laminated conductor, the method comprising:

providing a carrier substrate;

forming a metal seed layer on the substrate;

forming on the metal seed layer a sacrificial mold having a recess exposing the metal seed layer;

forming a first flat metallic conductor in said recess on said metal seed layer;

forming a sacrificial layer on said first flat metallic conductor;

forming a second flat metallic conductor on said sacrificial layer;

removing said sacrificial mold;

etching a peripheral portion of said sacrificial layer, thus forming a gap between the edges of said first and second flat metallic conductors;

forming a dielectric material anchor on at least one side of said first and second flat metallic conductors such that a portion of the dielectric material anchor is arranged between said first and second flat metallic conductors;

removing the metal seed layer remaining exposed; and removing the remainder of said sacrificial layer.

2. The method of claim 1, wherein said sacrificial layer has a thickness of between several nanometers and several micrometers.

3. The method of claim 1, wherein said flat metallic conductors have each a thickness of between several nanometers and several micrometers.

4. The method of claim 1, wherein said flat metallic conductors comprise Au, AG or Cu.

5. The method of claim 4, wherein said sacrificial layer comprises Ni.

6. The method of claim 5, wherein forming said flat metallic conductors and said sacrificial layer is done by electroplating.

7. The method of claim 1, further comprising depositing a dielectric coating on said two flat metallic conductors after removing the remainder of said sacrificial layer.

8. The method of claim 1, wherein each of the at least two flat metallic conductors have first and second extremities; the method comprising electrically connecting together the first extremities of the at least two flat metallic conductors and electrically connecting together the second extremities of the at least two flat metallic conductors.

9. The method of claim 8, comprising electrically connecting the first extremities of the at least two flat metallic conductors to a common conductor.

10. A method of forming a planar inductor, the method comprising:

forming a conductive pad layer on a substrate;

forming on the conductive pad layer a sacrificial mold exposing the conductive pad layer along at least two recesses in the shape of one turn of a spiral interrupted by a radial cut: a first recess developing from an inner end of the spiral to said radial cut; and a second recess developing from the radial cut to an outer end of the spiral;

in each recess of the sacrificial mold, forming a conductive stack comprising at least a first flat conductor covering the exposed portion of the conductive layer; a sacrificial layer covering said first flat conductor, and a second flat conductor covering said sacrificial layer;

removing the sacrificial mold;

etching away the conductive pad layer not covered by the conductive stacks, except: along a first waveguide connecting to the outer end of the spiral; along a second waveguide connecting to the inner end of the spiral through the radial cut in the spiral; and along ground pads arranged at a distance of the conductive stacks and the first and second waveguides;

forming a photoresist layer covering at least the second waveguide in the radial cut in the spiral without covering the top portions of the conductive stacks, and forming on the photoresist layer a conductive bridge connecting the top portion of the conductive stacks above the radial cut in the spiral;

removing the photoresist layer;

etching a peripheral portion of the sacrificial layer of the conductive stacks, thus forming a gap between the edges of the first and second flat conductors of the conductive stacks;

forming a dielectric material anchor on at least one side of said first and second flat conductors of the conductive stacks such that a portion of the dielectric material anchor is arranged in said gap between said first and second flat conductors; and removing the remainder of said sacrificial layer of the conductive stacks.

11. The method of claim 10, wherein:

forming said sacrificial mold exposing the conductive pad layer along at least two recesses in the shape of one turn of a spiral interrupted by a radial cut comprises forming: a first recess developing from an inner end of the spiral to a first side of said radial cut, at a first distance from the center of the spiral; a second recess developing from a second side of the radial cut, at a second distance from the center of the spiral, to an outer end of the spiral; and at least a third recess developing along one loop of the spiral between the second side of said radial cut, at said first distance from the center of the spiral and the first side of said radial cut, at said second distance from the center of the spiral; and forming said conductive bridge above said radial cut comprises forming a first conductive bridge above the radial cut at said first distance from the center of the spiral and forming a second conductive bridge above the radial cut at said second distance from the center of the spiral.

* * * * *